United States Patent [19]

Scouten

[11] Patent Number: 4,592,483

[45] Date of Patent: Jun. 3, 1986

[54] CONTAINER AND SEPARATE CO-OPERATING LID

[76] Inventor: Raymond E. Scouten, 145 Montrose St., Winnipeg, Manitoba, Canada, R3M 3L8

[21] Appl. No.: 609,353

[22] Filed: Aug. 6, 1984

[51] Int. Cl.[4] ..... B65D 45/00

[52] U.S. Cl. ..... 220/379; 220/85 CH

[58] Field of Search ..... 220/379, 307, 352, 85 CH

[56] References Cited

U.S. PATENT DOCUMENTS 2,259,770 10/1941 Nove ..... 220/85 CH
3,015,405 1/1962 Sterling ..... 220/85 CH X

FOREIGN PATENT DOCUMENTS 22328 of 1908 United Kingdom ..... 220/379
632054 11/1949 United Kingdom ..... 220/379
763410 12/1956 United Kingdom ..... 220/85 CH

*Primary Examiner*—Steven M. Pollard
*Attorney, Agent, or Firm*—Stanley G. Ade

[57] ABSTRACT

A container and co-operating separate lid is provided where the lid includes a projecting portion for in a closed position extending downwardly into the container and in an opened position having a recess defining having a pair of legs so that the legs sit astride the edge of the container. The container can be rectangular with four opening directions or circular with the possibility of opening in any direction. The container can have an upper edge defining an inverted V-shape surrounding the opening for receiving the upper edge of a carton. In the circular arrangement the projecting portion on the under surface of the lid can include a flange which is elliptical so as to turn into locking engagement with projections on the inner surface of the container.

2 Claims, 7 Drawing Figures

CONTAINER AND SEPARATE CO-OPERATING LID

BACKGROUND OF THE INVENTION

This invention relates to a container and a separate co-operating lid therefore which is of a particular construction which enables the lid to be pivoted from a closed position overlying an open mouth of the container to an open position without the use of hinges or other connections between the container and lid, Containers of various types for containing various articles such as garbage, food and other household items have been manufactured of various types and constructions. Generally a lid for the container is coupled to the container on hinges which allow it to be pivoted from a closed position overlying the container to an open position. Other containers have separate lids which can be lifted off the container and placed at a separate location or held in the hand of the user.

It is one object of the present invention to provide an improved construction of container and separate co-operating lid which allows the lid to be a separate item but yet pivotally mounted on the container.

Accordingly the invention provides a container and separate co-operating lid therefore, the container having an open mouth surrounded by a generally upstanding rim and the lid having a top portion of sufficient extent to cover the open mouth when in a closed position and a portion on an underside of said of top portion projecting therefrom inwardly into said container, said underside portion including a recess arranged in a side surface thereof such that the lid can pivot relative to the rim from the closed position to an open position in which the lid sits astride the rim with the rim projecting into said recess.

The lid therefor can be lifted from a position overlying the mouth of the container to a position in which it sits astride an upper edge of the container with the mouth open. Preferably the lid includes an upper flange overlying the opening or mouth of the container and extending outwardly to the sides so that the lid can be grasped by the flange and lifted or can be raised by depressing the opposite edge of the flange.

In a particularly preferred arrangement the upper part of the container is formed by a rim having an inverted V-shaped surrounding the opening with the recess of the lid having a similar V-shape for sitting astride the rim. In this arrangement the underside portion of the lid can at its outermost extent co-operate with the innermost edge of the rim.

With the foregoing in view, and other advantages as will become apparent to those skilled in the art to which this invention relates as this specification proceeds, this invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
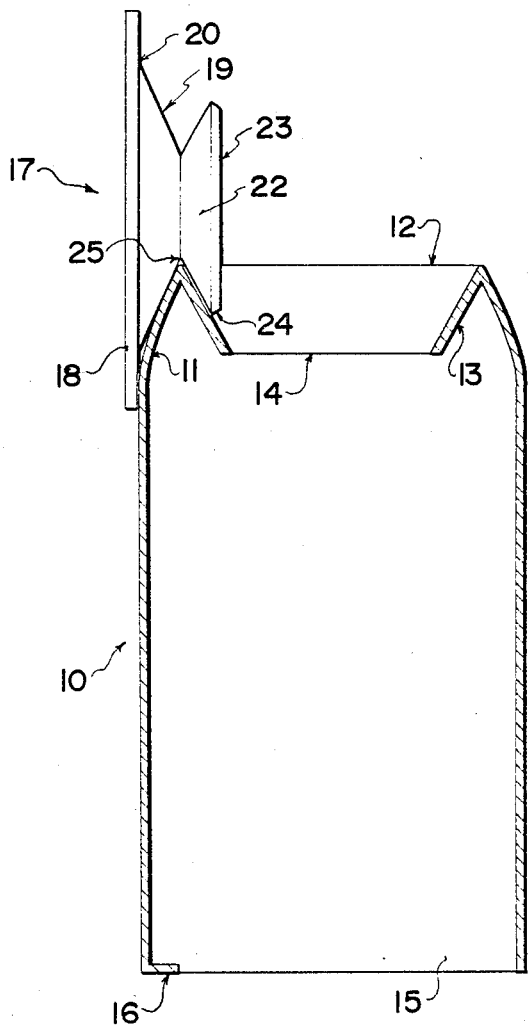
FIG. 1 is a transverse cross-sectional view of a container and lid according to the invention showing the lid in the open position.
Figure 2:
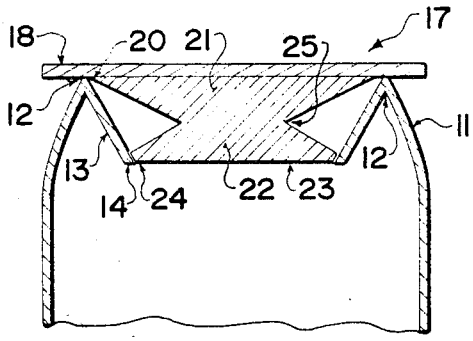
FIG. 2 is a partial cross-sectional view similar to FIG. 1 showing the lid in the closed position.
Figure 3:
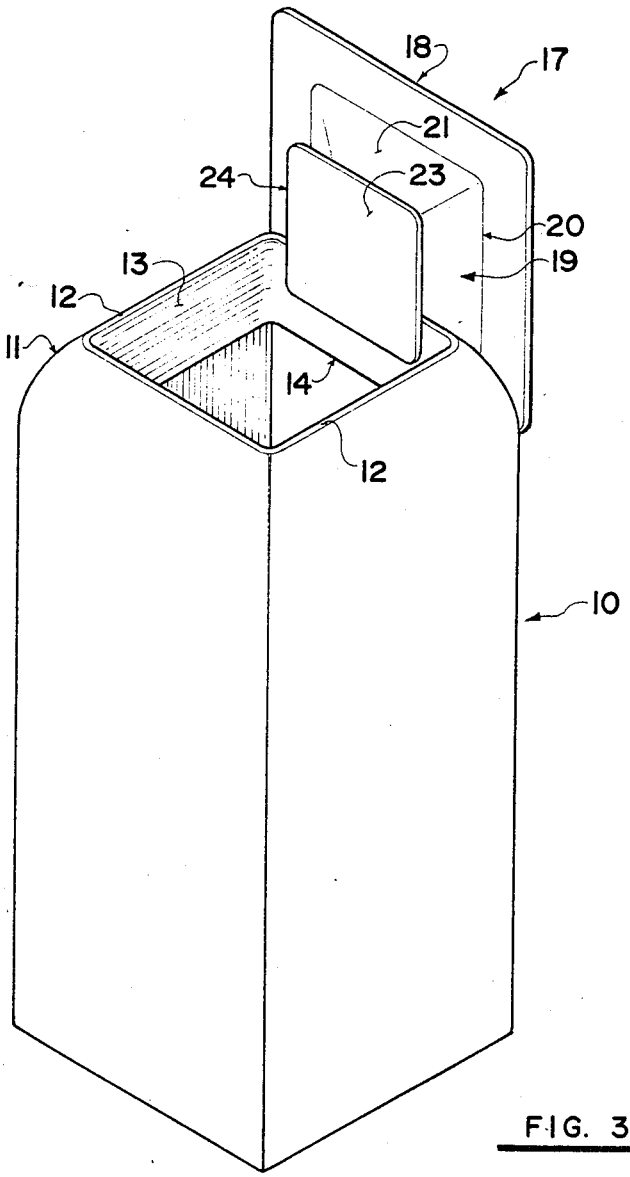
FIG. 3 is an isometric view of the container of FIG. 1 showing the lid in the open position.

In FIGS. 1, 2 and 3 is a shown a substantially rectangular container which can be formed from thin walled plastics material defining a generally rectangular body 10. At the upper end, the body 10 curves inwardly at 11 to form an upper edge 12 which is similarly rectangular or square but of reduced dimension relative to the main body 10. From the upper edge 12, the thin wall depends downwardly and inwardly to form a flange 13 which terminates at a lower inner edge 14. Thus the rim 12 forms the apex of an inverted V-shape defined by the portions 11 and 13 with the portions 11 and 13 being substantially equal in length and in angle relative to a vertical plane passing through the apex 12.

The bottom end of the container 10 is open at 15 with at one edge a step or inwardly projecting flange 16. In this embodiment the dimension of the main body or container 10 is arranged such that with the bottom of a conventional 2-liter milk carton sitting on the step 16 an open upper edge of the carton projects into the inverted V-shape surround the edge 14. Thus the milk carton can provide a container for garbage or other materials but is entirely hidden within the container 10 and is held in an open position by the inverted V-shape at the upper edge of the container.

A lid 17 comprises a flat substantially rectangular flange 18 which preferably has dimensions substantially equal to the outer dimension of the container 10 so that it can lie over the container 10 closing the mouth around the rim 12 and providing outwardly extending flange portions around the rim 12.

On the underside of the flange 18 is provided a lid insert portion 19 which from the flange 18 projects in the closed position downwardly from the rim 12 into the container. The downwardly projecting or underside portion 19 has outer periphery adjacent the flange 18 indicated at 20 which is of the same dimensions as the rim 12 so that in the closed position the edge 20 lies just inside the rim 12. From that edge 20, the underside portion 19 inclines inwardly forming a truncated pyramidal portion 21 at a very much sharper angle than the portion 13 of the container. The truncated portion 21 is connected top to top with a further truncated pyramidal portion 22 having substantially the same angle of inclination of wall. The portion 22 terminates in a flat base 23 parallel to the flange 18 and of rectangular dimension equal to the dimensions of the edge 14 of the container so that in the closed position it will be appreciated that, as shown in FIG. 2, the edge 20 co-operates with the rim 12 and also the edge 24 of the underside portion 22 co-operates with the innermost edge 14 of the container to locate the lid properly centred and oriented relative to the container.

The portion 22 defining the edge 24 is not intended as a sealing arrangement relative to the container but merely acts as a location device and also co-operates in the open position to retain the lid on the container as shown in FIG. 1. It is therefore in the closed position as illustrated in FIG. 2 a loose fit relative to the edge 14 and does not require twisting or maneouvering to lift away from the edge 14. However the loose fit and the co-operation of the edge 20 with the rim 12 ensures that the lid is properly closed and thus can control odours from garbage or other materials and provides a neat and pleasing appearance.

When moving to the open position illustrated in FIGS. 1 and 3, the flange 18 can be grasped or lifted at a side at which the lid is to be opened where upon the lid 17 will pivot relative to the apex or rim 12 and also will slide relative to the rim 12 such that the rim moves along the inclined wall 21 to the junction between the two truncated portions indicated at 25. In this position the two truncated portions 21 and 22 provide a pair of legs which sit astride the up turned V-section defined by the portions 11 and 13 and in that position is relatively stable. In that position the flange 18 is substantially vertical in open position and remains stably in the open position until it is moved with a further pivotal movement about the apex 12 back to the closed position illustrated in FIG. 2.

As shown in FIG. 3, the rectangular cooperation of the lid and container provides that the lid can be opened in any of four directions and in those directions can sit astride the container in stable position. However the simple co-operation between the lid and container means that the lid can also be removed from the container since it is completely separate therefrom without any disconnection of mechanical parts. The lid and container therefore are of simple uncomplicated shapes which can be kept clean without any difficulty.

Figure 4:
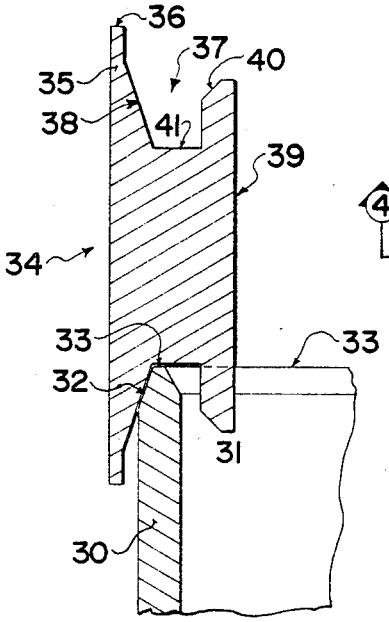
FIG. 4 is a transverse cross-sectional view of a second embodiment of container and lid.
Figure 5:
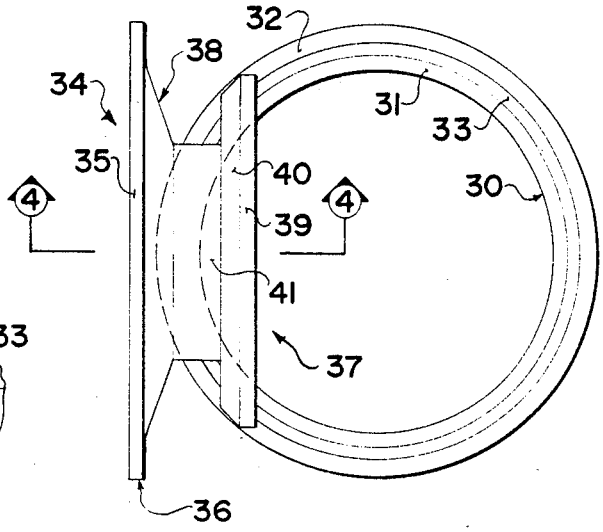
FIG. 5 is a plan view of the container and lid of FIG. 4 showing the lid opened in the opposite direction.

Turning now to FIGS. 4 and 5, second embodiment is illustrated in which the container and lid are circular as opposed to the square or rectangular shape of the previous embodiment.

In this arrangement the container having a cylindrical wall is indicated at 30, the upper edge of the wall having chamfered inner and outer edges indicated at 31 and 32 respectively thus defining a top edge 33 which is annular and a width substantially reduced relative to the thickness of the wall 30.

The lid indicated at 34 includes a flat circular flange portion 35 which in a closed position can overlie the top edge 33 so as to close the upper open end of the container. The outer edge of the flange 35 indicated at 36 is arranged to be substantially the same diameter as the container itself so that in the closed position (not shown) the edge 36 lies substantially in the same cylinder as the outer surface of the wall 30.

The lid in a similar manner to the lid of the previous embodiment includes an underside portion generally indicated at 37. However in order to accommodate the circular shape of the container, the underside side portion 37 is of modified shape. Specifically a first frusto-conical portion thereof indicated at 38 is of shallow angle substantially equal to the angle of the outer chamfer 32 so that in the open position in the cross-section as shown passing through the centre of the cylindrical container the chamfer 32 and face of the frusto-conical portion 38 lie in line contact. The other portion indicated at 39 is effectively defined by a flange of diameter slightly less than the inner diameter of the container and having a chamfered edge 40 facing toward the outer face of the frusto-conical portion 38 so that, as shown in FIG. 5, the chamfered edge 40 at two points on the periphery engages the inner chamfered edge 31 of the container. Thus the lid in the open raised position shown in FIGS. 4 and 5 is supported at the three points as previously defined thus providing a substantially stable raised position. As the container and lid are cylindrical and circular, the lid can of course be raised in any direction by lifting the flange 35 at a desired point and then will sit over the rim at a point opposite to the raised point. In this embodiment the recess between the portion 38 and the flange 39 indicated at 41 is cylindrical rather than the simple line contact of the previous embodiment in order to accommodate the curvature of the upper edge of the container. As with the previous embodiment the flange 39 does not seal with the inner surface of the container and therefore is in loose fit therewith but the flange 39 and also the frusto-conical portion 38 act to locate or centre the lid relative to the container so that from the raised position it can be merely knocked forwardly and then automatically centres itself into the closed position (not shown).

Figure 6:
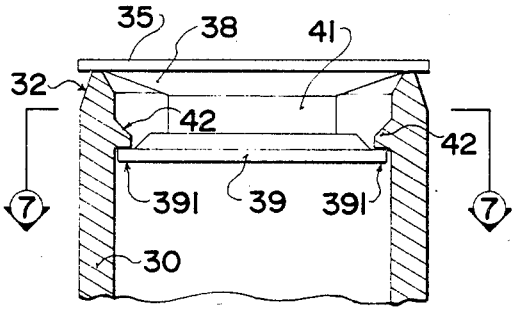
FIG. 6 is an transverse cross-sectional view of a third embodiment of container and lid incorporating a screw locking arrangement.
Figure 7:
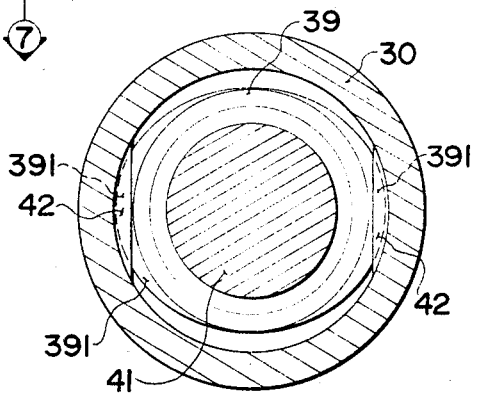
FIG. 7 is a cross-sectional view along the lines 7—7 of FIG. 6.

The embodiment illustrated in FIGS. 6 and 7 is a modification of that illustrated in FIGS. 4 and 5 wherein the flange 39 is in plan view elliptical or of a shape which is enlarged at two opposed edges relative to edges at 90° thereto. In addition the container 30 has on its inner face at two opposed position projections 42. Thus in the position illustrated in FIGS. 6 and 7 the flange 39 can be turned to a position where it underlies the projections 42. To open the container, the lid and flange 39 can be rotated to the position where the enlarged portion 391 is at 90° to the projections 42 following which the lid can be raised into the position illustrated in FIGS. 4 and 5. The upper surface of the flange 39 at the projecting portion 391 and/or the under surface of the projections 42 can be inclined relative to a radial plane of the container so that as the flange 39 is turned with the lid, the engagement between the upper surface of the flange 39 and the under surface of the projections 42 gradually increases to provide a locking action.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in alimiting sense.

I claim:

1. A container and separate co-operating lid therefor, the container having an open mouth surrounded by a generally upstanding rim of regular polygonal shape defining a plurality of sides and the lid having a top portion of sufficient extent to cover the open mouth when in a closed position and a portion of similar polygonal shape defining a similar plurality of sides on an underside of said top portion projecting therefrom inwardly into said container, said underside portion including a recess arranged in each of the sides thereof such that the lid can pivot relative to the rim from the losed position to an open position in which the lid sits astride the rim with the rim projecting into the recess, each side of said rim having a shape in cross section of an inverted V so as to define an outwardly facing inclined surface and an inwardly facing inclined surface, said recess of each side of said underside portion having a similar V shape so as to define, when sitting astride the rim, a first surface intersecting the top portion which lies in contact with the outwardly facing inclined surface and a second surface intersecting a lowermost edge of said underside portion which lies in contact with said inwardly facing inclined surface whereby said top portion is maintained substantially vertical and such that, when in a closed position, an intersection between the top portion and the first surface substantially engages said rim and an intersection between said second surface and said lowermost edge substantially engages an interior surface of said container whereby to maintain said lid in centered position on said rim.

2. A container and separate co-operating lid therefor, the container having an open mouth surrounded by a generally upstanding circular rim and a lid having a top portion of sufficient extent to cover the open mouth when in a closed position and a circular portion on an underside of said top portion projecting therefrom inwardly into said container, said underside portion including a recess surrounding a side thereof such that the lid can pivot relative to the rim from the closed position to an open position in which the lid sits astride the rim with the rim projecting into the recess, said rim having a shape in cross section of an inverted V so as to define an outwardly facing inclined surface and an inwardly facing inclined surface, said recess of said underside portion having a similar V shape in cross section so as to define, when sitting astride the rim, a first surface intersecting the top portion which lies in contact with the outwardly facing inclined surface and a second surface intersecting a lowermost edge of said underside portion which lies in contact at two spaced positions with said inwardly facing inclined surface whereby said top portion is maintained substantially vertical and such that, when in a closed position, an intersection between the top portion and the first surface substantially engages said rim at an intersection between said second surface and said lowermost edge substantially engages an interior surface of said container whereby to maintain said lid in centered position on said rim.

* * * * *